US007722485B2

(12) United States Patent
Balasubramanyan

(10) Patent No.: US 7,722,485 B2
(45) Date of Patent: May 25, 2010

(54) TENNIS SERVE BALL MACHINE CUM TRAINING DEVICE

(76) Inventor: Ramesh Balasubramanyan, 3617 Camellia Dr. South, Salem, OR (US) 97302

( * ) Notice: Subject to any disclaimer, the term of this patent is extended or adjusted under 35 U.S.C. 154(b) by 585 days.

(21) Appl. No.: 11/582,597

(22) Filed: Oct. 18, 2006

(65) Prior Publication Data

US 2008/0096697 A1 Apr. 24, 2008

(51) Int. Cl.
*A63B 69/00* (2006.01)
*F41B 15/00* (2006.01)
*A69B 69/38* (2006.01)

(52) U.S. Cl. ..... 473/422; 473/459; 473/451; 124/54

(58) Field of Classification Search ..... 473/422, 473/431, 451, 459; 124/1, 6, 45, 54
See application file for complete search history.

(56) References Cited

U.S. PATENT DOCUMENTS 3,231,271 A * 1/1966 Murphy ..... 473/461
4,021,036 A * 5/1977 Nelson et al. ..... 473/459
4,023,798 A * 5/1977 Pronin ..... 473/462
4,141,550 A * 2/1979 Denizman ..... 473/462
5,011,143 A * 4/1991 Jones ..... 473/459
5,066,010 A * 11/1991 Pingston ..... 473/451
5,097,985 A * 3/1992 Jones ..... 221/86
5,520,397 A * 5/1996 Thompson ..... 473/459
5,669,834 A * 9/1997 Slupskiy ..... 473/459
5,980,399 A * 11/1999 Campbell et al. ..... 473/459
6,616,555 B2 * 9/2003 Bewley ..... 473/451
6,776,732 B2 * 8/2004 Parkinson et al. ..... 473/431
2003/0101978 A1 * 6/2003 Smith et al. ..... 124/69

FOREIGN PATENT DOCUMENTS

WO PCT/SK95/00006 5/1997

* cited by examiner

*Primary Examiner*—Mitra Aryanpour
(74) *Attorney, Agent, or Firm*—Rylander & Associates PC; Kurt M. Rylander; Jon C. Reali

(57) ABSTRACT

This invention, called Serve Assist, is an electro-mechanical ball machine for practicing the tennis serve. It helps a tennis student to practice serves by consistently dropping the ball in the desired location. It operates in one of two modes, an Auto-feed mode in which it drops the balls in the magazine via an overhead ball release canister at regular intervals or in an Auto-sense mode where the ball is released by the detection of the student's rising tossing arm. The invention also marks the desired height of contact on the dropping ball with a laser and provides visual feedback if the ball is being struck lower than optimum. It aids the student by developing a kinetic and visual memory of the correct ball toss position and point of contact.

9 Claims, 10 Drawing Sheets

TENNIS SERVE BALL MACHINE CUM TRAINING DEVICE

BACKGROUND OF THE INVENTION

The tennis serve is a challenging part of the game, and probably one of the most frustrating and the weakest link in a good tennis player's game. Though ball machines exist that allow practicing ground strokes like forehand, backhand, volley and overhead, there is practically no device that assists the student of tennis with their serve on the tennis court today.

Patents that aid with the ball tossing to provide target practice exist, but none seem to put the ball in the right place and allow the player to actually hit it. The challenge of a tennis coach, as she watches the student struggle with the toss as a beginner or intermediate player, is to first get the player to toss the ball at the desired location, before getting her to hit the correct ball at the desired height. Coaching time is partly wasted because the student is actually tossing the ball in the incorrect position and thus hitting faulty serves.

This invention will drop the ball for the student at the desired location at the desired instant, so the student can actually hit the ball and realize for herself the fruits of tossing the ball at the desired location. The kinetic and visual memory built by repeatedly hitting the ball at the correct location and instant will be invaluable in finally realizing where to toss the ball, so as to hit the correct serve.

For the intermediate player, a tennis coach has to struggle with finer points like refining the point of contact. No device exists that provides visual feedback on ideal point of contact between the racket and ball elevation when hitting the serve. Also, on the same lines it is very common for intermediate players to make contact with the ball lower than optimum, hitting incorrect serves. No visual feedback is currently available to a tennis coach to literally highlight this point.

BRIEF SUMMARY OF THE INVENTION

This invention is a sophisticated ball machine that releases the ball to the tennis student at the appropriate height and allows the student to practice the serve without actually releasing a tennis ball from her tossing arm. The machine is first setup on the tennis court by the student, either alone or with the assistance of the coach, who sets the machine to release the ball at the appropriate height and depth into the court.

The machine operates in one of two modes. In the auto-sense mode, the device detects the rising tossing arm of the student, by an interruption of a light beam or similar device to start a timer. After a customizable delay, a ball is released from the overhead ball release canister, which is about 18 to 20 inches above the optimum point of contact between racket and ball. The ball is marked by a horizontal laser beam with a bright red dot as it falls through the optimum point of contact.

If the ball is not hit by the player it falls lower and is marked by another horizontal line laser, which signifies that the ball has fallen beyond the strike zone. With some trial and error, the player can set the adjustable time delay between the start of the serving action, which is the raising of the tossing arm and the final release of the tennis ball from the overhead canister.

In the auto-feed mode, a ball is released once every 8 to 10 seconds from the overhead canister with an audible alert to start her serving motion. With some trial and error, the student can set the delay between the alert to start the serving motion and the ball release. Once this is set, the student can practice hitting about 10 to 12 serves with the balls in the Magazine, before stopping to reload the magazine.

A critical part of the invention is the magazine that holds the balls to be released. This magazine holds up to 12 balls and is attached to a motor housing that contains the drive motor. The motor housing is mounted on one end of a horizontal cross beam, with a counter balancing weight at the other end for stability. The cross beam can ride vertically on a threaded vertical rod. The cross beam also supports the sensor and laser mechanisms. This cross beam can be raised and lowered with electrical power assistance. The cross beam can be lowered, so the magazine is at about 6 feet above ground, to enable easy loading of the balls. The fine adjustments for the laser and motion sensor mechanisms will also be performed when the cross beam is in the lowered position.

The delay controllers for the time delays will be provided on a control box attached to the main post at eye level.

DETAILED DESCRIPTION

The invention consists of a transportable overhead ball machine on castors that can be wheeled on to the tennis court by the student and used either alone or in consultation with a coach. The invention is positioned in place just behind the baseline of the tennis court, so the overhead ball release canister 1 of FIG. 1 is at the correct position inside the court where the student wants the ball to drop.

Figure 1:
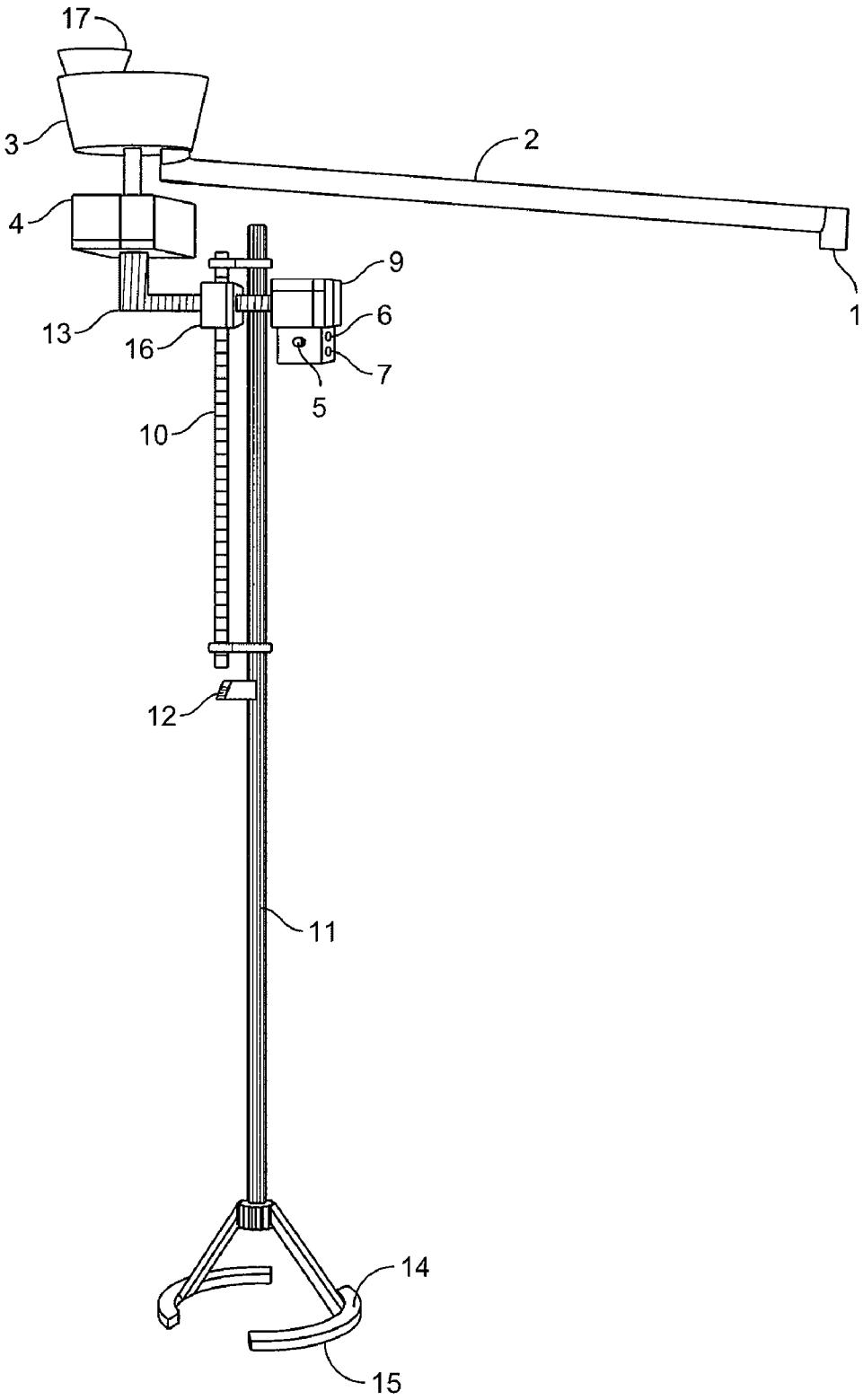
FIG. 1—Perspective View of the Invention showing all the major components
Figure 2:
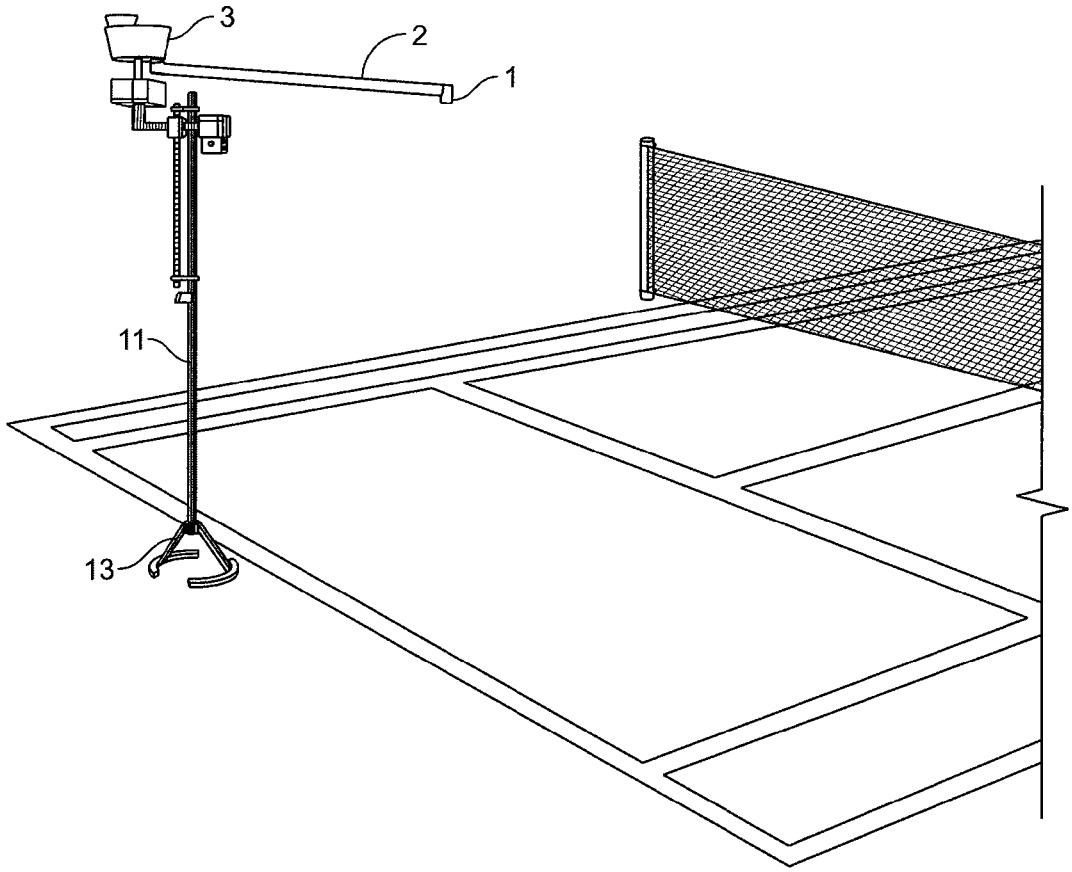
FIG. 2—Perspective View of the Invention in relation to the tennis court
Figure 3:
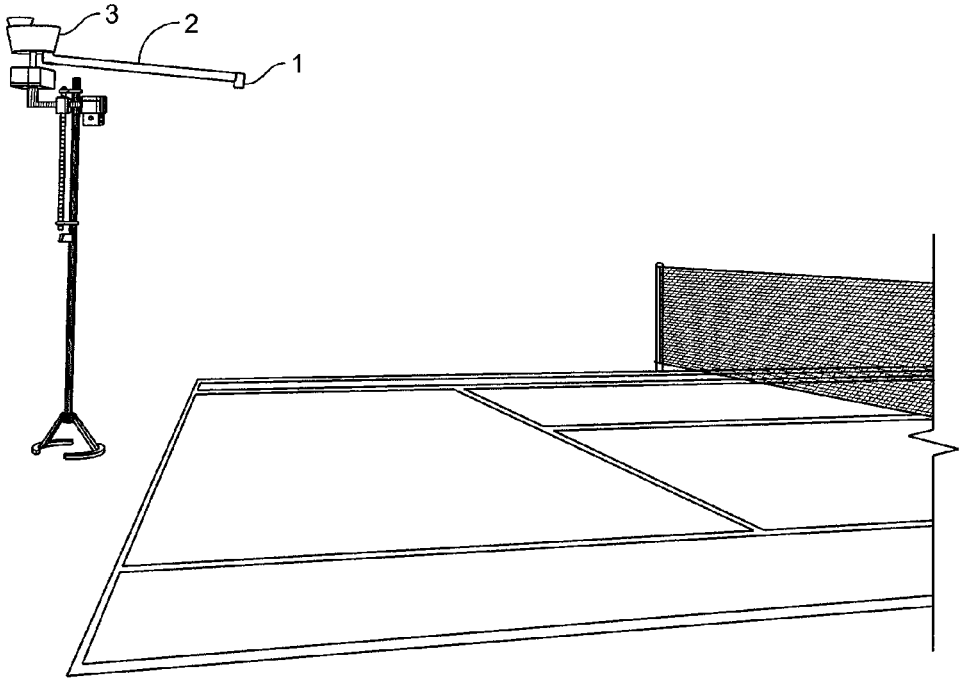
FIG. 3—Elevation of the Invention in relation to the tennis court from the side of the court, close to the base line with magazine raised FIG. 4—Side Elevation of the Invention in relation to the tennis court from behind the Baseline FIG. 5—Close-up of the Tossing arm sensor unit FIG. 6—Close-up of the Magazine, Drive motor and the riding support beam, showing the raising/lowering mechanism FIG. 7—Close-up of the Ball-release canister FIG. 8—Close-up of the Laser marker system FIG. 9—Elevation of the Invention in relation to the tennis court from the longer side of the court, close to the Base line with the Magazine in lowered position.
Figure 4:
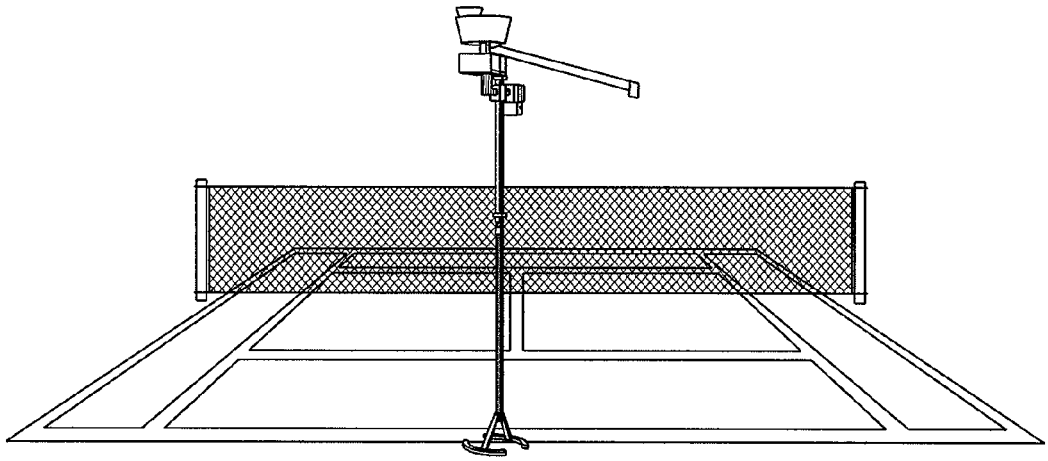

As FIG. 2 shows the invention in relation to the court, one can see the base 13 of FIG. 1 and the upright support 11 clearly out of the way of the Student and behind her. In consultation with the Coach the student can position the invention in such a way that the overhead ball release canister 1 is anywhere from, vertically on top of the baseline to 18 inches inside the court, based on her preference or the type of service to practice.

While practicing with the invention, the student does not actually release the tennis ball for the serve from her tossing hand, but performs the same motion like a real serve. The invention senses the rising tossing arm of the student (sensor 5) and starts an electronic adjustable timer that sends an impulse to the ball release canister 1. The detailed description of use of the machine is provided later in this section.

The critical piece of this invention consists of an overhead ball release canister that releases the ball at the desired height at the appropriate time in the serving motion. As FIG. 1 shows, Numeral 1 is the ball release canister that releases one ball at a time from its overhead position. The ball release canister 1 is compact and sized to hold only one ball. The ball release canister 1 is positioned about 18 to 21 inches above the optimum point of impact between racket and ball, thus putting it out of swing path of the racket. The detailed description of the ball release canister with drawing is provided later in this section.

In the manual feed mode, the Ball release canister 1 is triggered to release the ball by an electrical impulse received from an electronic timer delay circuit (housed in control box 12) that is in turn, triggered by the motion sensor 5. The motion sensor 5 detects the rising tossing arm of the student above a certain height and provides a trigger to a timer circuit, which after a customizable delay sends an impulse to the ball release canister. On receiving the electrical impulse, a Servo inside the ball release canister 1 opens a door releasing the ball. The detailed description of the motion sensor with drawing is provided later in this section.

As shown in FIG. 1, the Ball release canister 1 is attached to the end of a Chute 2 that is attached to the Magazine 3. When a ball is released by the ball release canister 1, the drive motor 4 attached to the Magazine is also activated by the same electronic impulse and the magazine 3 releases one ball. The ball travels by gravity from the Magazine 3 via the chute 2 and arrives at the ball release canister 1. Here it awaits the next impulse from the Electronic timer circuit.

In the Auto feed mode, the drive motor 4 attached to the magazine 3 runs continuously and feeds one ball every 8 to 10 seconds to the ball release canister 1 via the chute 2. In this mode an audible alert is sounded for the student begin her serving action, and after the appropriate time delay (0.5 seconds to 1 second), the ball is released from the Ball release canister. As the ball falls from the canister, the student is in the appropriate posture of the serve, to spring up and hit the ball, uninterrupted like she had tossed the ball herself. With some trial and error, the student can customize the delay with the timer knob 25 to let the ball drop at the correct instant from the ball release canister. The description of the timer is provided later in this section.

Figure 8:
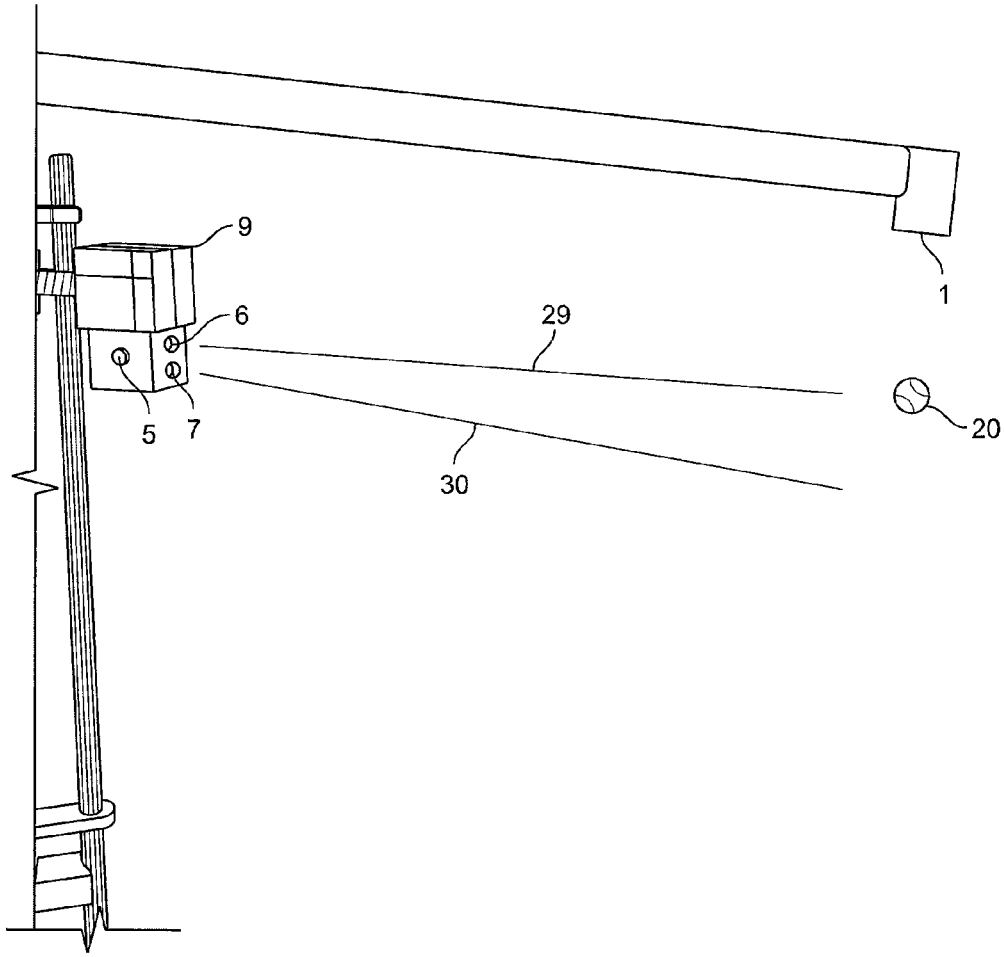
Figure 9:
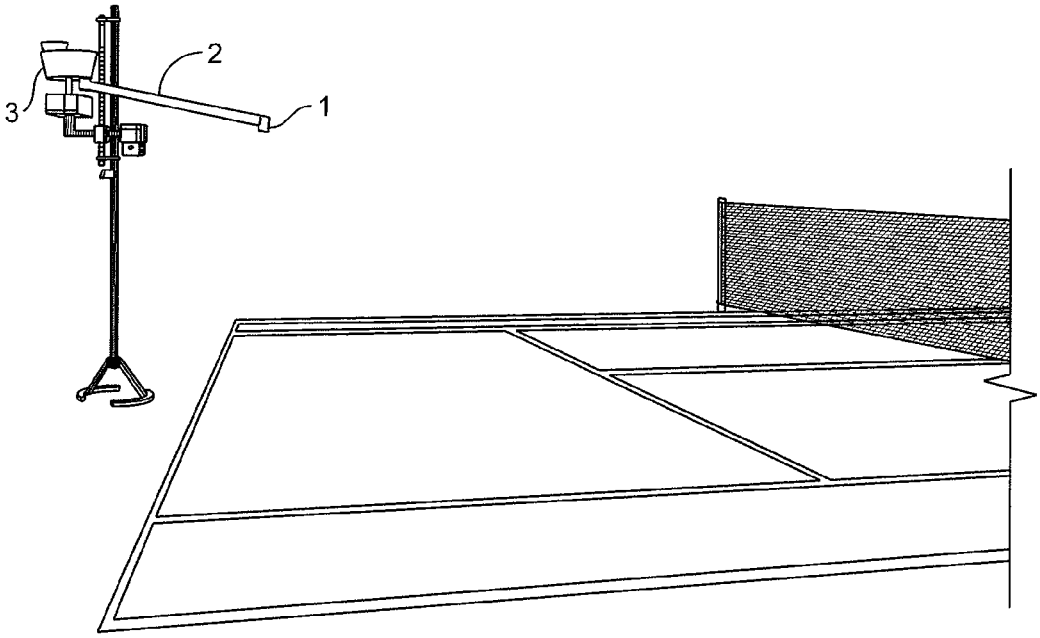

As the ball falls from the canister, the student can optionally use the laser marker 6, to illuminate the ball at the elevation where she would ideally like to make contact with the racket as shown in FIG. 8. Laser marker 7, illuminates the ball with an inch wide horizontal line about 6 inches below the elevation of the previous laser 6 as shown in FIG. 8. If the racket impacts with the ball after Laser marker 7 has illuminated the ball, this usually signifies that the student is making late contact and allowing the ball to drop low. The exact setting of the Laser markers 6 and 7 can be adjusted with the Magazine assembly in the Lowered position as shown in FIG. 9. The detailed description of the Laser markers with drawing is provided later in this section.

In this Lowered position of the Magazine as in FIG. 9, is how the balls are loaded into the Magazine too. The magazine 3 can hold up to 12 balls to keep the weight low. The funnel attachment 17 at the top of the magazine 3 aids the easy loading of the balls into the ball magazine. The weight of the magazine, the motor assembly on one side of the support cross beam 13 is offset by the counter weight 9. The detailed description of the magazine and its loading is provided later in this section.

Raising/Lowering the Magazine and Ball Release Canister Assembly

Figure 6:
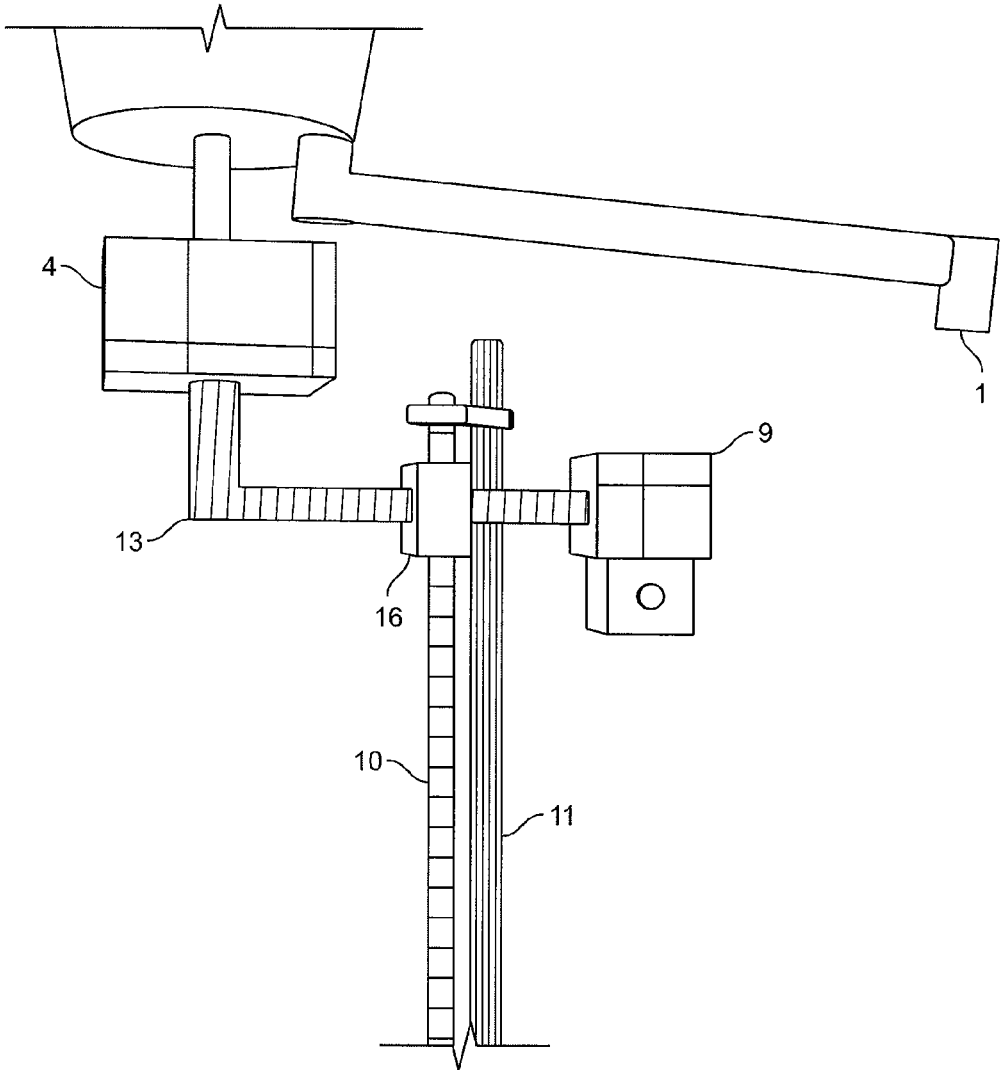
Figure 10:
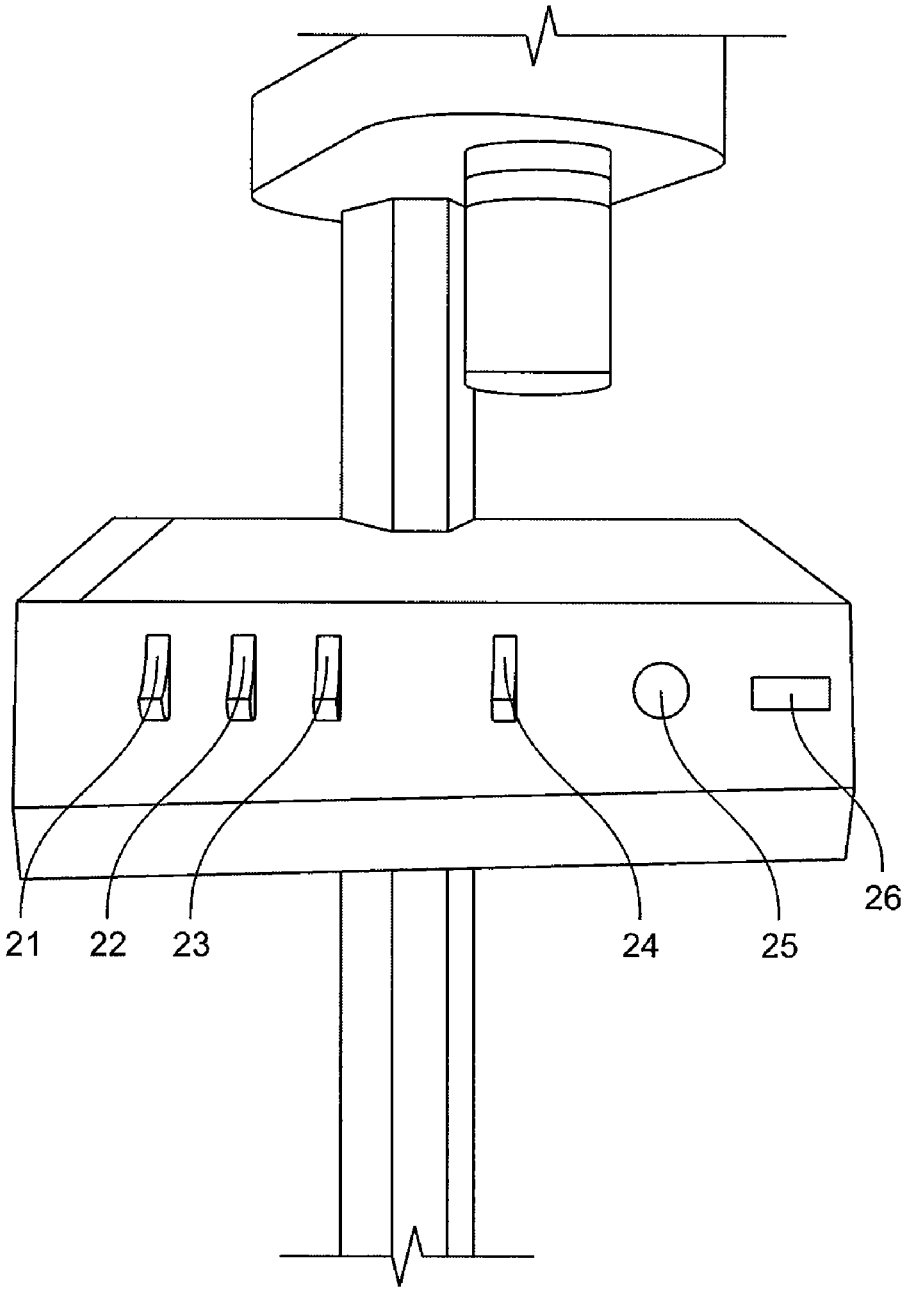
FIG. 10—Close-up of the Electronic control box showing the various controls

The Magazine 3, Motor drive 4, the counter weight 9 are all attached to the crossbeam 13 as shown in FIG. 6, and this cross beam in turn rides vertically up and down the vertical slide rod 10 which is attached to the main upright 11. The counter weight 9 compensates the weight of the magazine and the drive motor. The motor assembly in housing 16 will allow the cross beam 13 and all attached components to move and down and be set to the desired height. The height of the ball release canister is adjusted by using the up/down switch 14 as shown in FIG. 10. A counter 26 in FIG. 10 gives readout of the height of the ball release canister above the ground in inches. This readout of the height aids the student to set the machine when re-starting practices.

Magazine Loading

While the Magazine is in the lowered position, is when it is loaded with the balls. First the ON/OFF switch 21 of FIG. 10 is moved to the OFF position to de-energize the power to the Motor driving the magazine. The Up/Down switch 14 in FIG. 10, is depressed down for the magazine assembly to be lowered to its lowest height about 6 feet above the ground. When the Magazine assembly is in the lowered position as shown in FIG. 9, the balls can be tossed into the Funnel 17. The funnel aids the balls to trickle into the Magazine, which holds about 10 to 12 balls. After the balls are loaded, the Up/down switch 14 in FIG. 10 is pushed up to raise the Magazine assembly to the desired height. The height readout of the counter 26 of FIG. 10 helps with setting the ball release canister at the height desired.

Ball Release Canister Working

Figure 5:
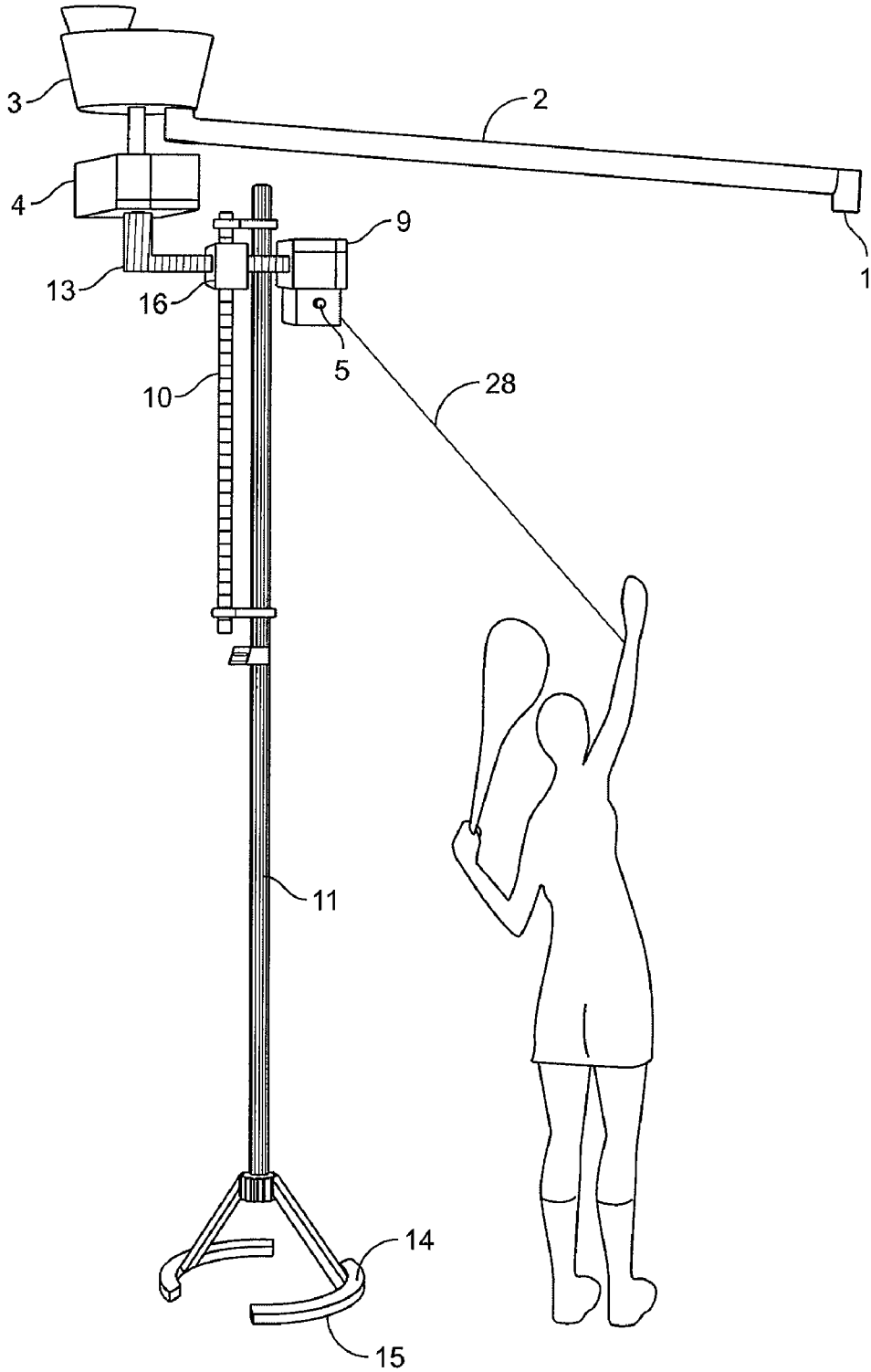
Figure 7:
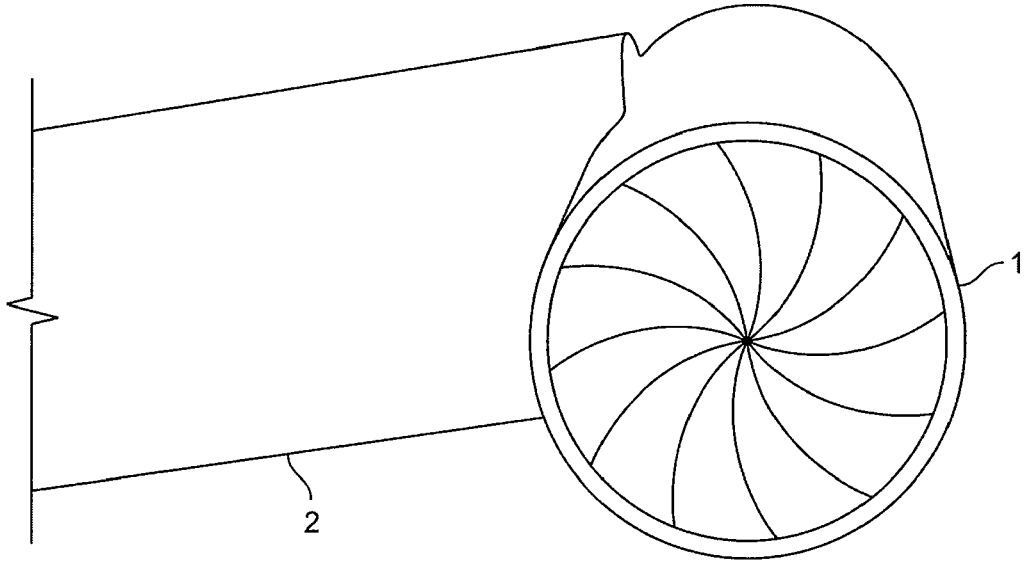

The ball release canister 1 of FIG. 1 is a cylinder attached to the other end of ball chute 2. It is just big enough to hold one ball and keeps the ball in place by means of a closed trap door as shown in FIG. 7. This trap door mechanism is actuated by a servo to open and releases the ball when needed. The servo mechanism receives its input from the electronic timer assembly described later in this section Tossing Arm Detection The tossing arm mechanism is critical in the working of the invention in the Auto-sense mode. In this mode the student pretends to be tossing a ball while practicing the serve by raising his tossing arm above her head. As FIG. 5 illustrates, sensor 5 senses interruption of light or infrared beam in a height range of 12 inches above the players head. FIG. 5 shows the beam 28 put out by the sensor 5.

Since the motion sensor 5 is riding the support-beam 13, its range of sensing is a function of height of the ball release. So a tall player about 6'2" would set the ball release canister height at about 11 and a half feet. The motion sensor will detect the tossing arm in the height range of 6'4" to 6'8". When the ball release canister height is lowered for a short player about 5'2", then the ball release canister height would be in the range of 10 and a half feet and the motion sensor will sense the tossing arm motion between 5'4" and 5'8".

The range of motion sensing height can be adjusted, but it should be left to the tennis coach. The tossing arm detection sensor feeds its signal to the electronic timer circuitry for processing. To prevent repeat false triggers, the circuitry accepting this input will have its sensitivity adjusted so that once triggered; the circuitry will not accept input until its ready for another cycle in about 5 seconds. The tossing arm detection sensor will be sensitive enough to be triggered within 3 feet range and will not be triggered by the falling ball or other movements around the invention.

Laser Markers

There are 2 laser markers to aid the student with recognizing an optimum point of contact between racket and ball. The Laser markers 6 and 7 are optional and are enabled by switch 23 of FIG. 10. The Laser markers are energized only for couple of seconds after the ball is released by the Ball release canister, to conserve the life of the laser and energy.

Markers 6 and 7 as shown in FIG. 1 and FIG. 8 are positioned on the Cross beam 13 that rides vertically with the ball drop canister height adjustment. Marker 6 is positioned in such a way that it focuses a spot on the ball about 18 inches below the ball release canister. Marker 7 is positioned to mark an inch wide horizontal line on the dropping ball about 6 inches below the spot marked by Marker 6. FIG. 8 shows the laser line 29 put out by Marker 6 and Laser line 30 put out by Marker 7. The key is for the student to perfect her serving motion so that she makes contact between racket and ball near or on the spot marked by Marker 6 as shown in FIG. 8. If the coach and the student continue to see the horizontal line on the ball before the student makes contact with the racket, then its apparent to both that the ball is being struck lower than desired.

The Laser Markers 6 and 7 are fixed on swiveling mounts and the direction of the beam can be adjusted by the tennis coach during calibration of the invention.

Timer Circuitry

The timer circuitry that is housed in control box 12 of FIG. 1 is based on a dual IC 555 electronic timer. In its Mono-stable mode, the Chip receives its trigger input from the Tossing arm detection sensor and produces a high output, after an adjustable time delay produced by the setting of a Potentiometer.

This Potentiometer is presented as the adjustable timer delay control 25 of FIG. 10. This circuitry can produce an accurate time delay of between 0.3 and 1.5 seconds, which can handle all range of serving motion speeds. The Timer circuitry feeds its output to the servo in the ball release canister and a power timer circuit, which energizes the Laser markers 6 and 7. This power timer circuit energizes the Laser markers 6 and 7 for just 1.5 seconds, just long enough to mark the ball falling from the ball release canister before being struck by the Racket.

Typical Usage

Setup

The student wheels in the invention just few inches behind the base line of the tennis court as shown in FIG. 2. The student or the coach positions the ball release canister 1, so that it is over the location where she wants the ball to drop, if she didn't hit ball during the practice serve. The student connects the power supply by plugging in the power cord into the utility socket.

The student or coach then proceeds to load the balls into the magazine. To do this the rocker switch 24 in FIG. 10 is pushed down to bring the Magazine assembly to its lowest point as shown in FIG. 9. Balls are then tossed into the Funnel 17 of FIG. 1 to load the magazine. The magazine can hold up to 12 balls. After the balls are loaded, the rocker switch is pushed up to raise the Magazine assembly so that the ball release canister is at the desired height. The reading in Counter 26 of FIG. 10, which is the height of the Ball release canister above the ground, is noted for future setting. The student then decides if she wants to use the machine in the Auto-sense mode or Auto feed mode and throws the Switch 22 in FIG. 10 appropriately.

Hitting the Serves

The student then proceeds to the service line to take a practice swing for tennis serve. To calibrate the invention correctly for her serve, the student needs to adjust the Timer delay 25 of FIG. 10 to make sure the tossing arm detection unit detects her tossing arm and releases the ball from the Ball release canister at the appropriate moment. In the first couple of practice serves, the student may realize that the ball is being tossed to soon or too late in the serving motion for the ball to be struck effectively. So it's best to set the delay to be late and practice with a deliberate slow serving motion and reduce the time delay down to a point where one is comfortable hitting the serves.

The student can then watch the Laser marking on the ball to make sure she is hitting the ball at the optimum height. There is a dot laser and a short horizontal line laser marking. The student should aim to make contact between racket and ball, when the ball is marked by a Laser dot. If the student finds herself hitting the ball after horizontal line markings, it is apparent that the ball is being struck lower. The laser markings are optional and can be turned off by switch 23 of FIG. 10.

The student can then proceed to use the invention in an Auto-Feed mode, by throwing the switch 22 in the appropriate position. In this mode, the invention give an audible alert for the student to start her serving motion and at the appropriate time drops the ball from the ball release canister for the serve to be hit. Again the time delay control 25 of FIG. 10 can be used to adjust the time delay between the audible alert and the ball drop instant.

The invention claimed is:

1. A tennis serve training apparatus dropping balls preloaded in a magazine from an overhead ball release canister in response to rising movement of the user's non-tennis racket holding arm, comprising:

a tossing arm rising movement sensor;

a programmable electronic timer delay circuit in signal communication with said tossing arm rising movement sensor having an electrical impulse transmitter;

a ball release canister in signal communication with said electronic timer delay releasing a ball in response to said electronic timer delay electrical impulse transmitter.

2. The tennis serve training apparatus of claim 1, further including a ball loading magazine having a driver motor in signal communication with said electronic timer delay circuit loading a ball from said magazine to said ball release canister.

3. The tennis serve training apparatus of claim 1, wherein said tossing arm rising movement sensor detects movement using an infra red beam interruption sensor.

4. The tennis serve training apparatus of claim 1, wherein said tossing arm rising movement sensor detects movement using an light interruption sensor.

5. The tennis serve training apparatus of claim 1, wherein said tossing arm rising movement sensor detects movement in a range of 3 feet.

6. The tennis serve training apparatus of claim 1, further including a laser marker in signal communication with said electronic timer delay circuit energizing a laser mark for 1.5 seconds illuminating a ball released from said ball canister.

7. The tennis serve training apparatus of claim 1, further comprising a laser marking a dropped ball at a predetermined height for optimum tennis serve strike.

8. The tennis serve training apparatus of claim 7, further comprising a second laser marking a dropped ball that has not been struck at the predetermined optimum tennis serve strike.

9. The tennis serve training apparatus of claim 1, further comprising a pair of laser marking a dropped ball within an optimum tennis serve strike zone.

* * * * *